US006276018B1

(12) United States Patent
Leiman et al.

(10) Patent No.: US 6,276,018 B1
(45) Date of Patent: Aug. 21, 2001

(54) FLEXIBLE PIPE CLEANING DEVICE AND SYSTEM

(76) Inventors: Basil C. Leiman, P.O. Box 79711, Houston, TX (US) 77279; Bruce D. Butler, 1609 Milford, Houston, TX (US) 77006

( * ) Notice: Subject to any disclaimer, the term of this patent is extended or adjusted under 35 U.S.C. 154(b) by 0 days.

(21) Appl. No.: 09/474,044

(22) Filed: Dec. 28, 1999

(51) Int. Cl.[7] ..... B08B 9/027

(52) U.S. Cl. ..... 15/104.19; 15/104.095; 15/104.33

(58) Field of Search ..... 15/104.05, 104.068, 15/104.09, 104.015, 104.13, 104.15, 104.16, 104.19, 104.33, 304, 395, 104.095

(56) References Cited

U.S. PATENT DOCUMENTS

| | | | | |
|---|---|---|---|---|
| 1,402,786 | | 1/1922 | Muehl . | |
| 2,125,864 | | 8/1938 | Auckland . | |
| 2,447,869 | | 8/1948 | Pearson et al. . | |
| 2,599,077 | | 6/1952 | Sturgis . | |
| 2,653,334 | | 9/1953 | Bay . | |
| 2,961,675 | * | 11/1960 | Stickney | 15/104.33 |
| 3,100,904 | | 8/1963 | Stocking . | |
| 3,445,879 | * | 5/1969 | Taylor | 15/104.16 |
| 4,224,072 | | 9/1980 | Stewart . | |
| 5,199,129 | * | 4/1993 | Salecker et al. | 15/104.33 |
| 5,230,116 | | 7/1993 | Rodriquez . | |
| 5,383,243 | | 1/1995 | Thacker et al. . | |
| 5,768,741 | | 6/1998 | Leiman et al. . | |
| 5,809,603 | * | 9/1998 | White | 15/104.095 |
| 5,987,683 | | 11/1999 | Leiman et al. . | |
| 5,987,684 | * | 11/1999 | Evans | 15/104.33 |

OTHER PUBLICATIONS

Basic Plumbing, Sunset Books, pp. 8–9, 28–32, (date unknown).

Home Plumbing Projects & Repairs, Black & Decker Home Improvement Library, pp 88–89, (Cy DeCosse Incorporated 1990).

Do your Own Plumbing, Popular Science, pp 12, 43 (Popular Science books 1987, reprinted in 1991 by Sterling Publishing Company, Inc).

* cited by examiner

*Primary Examiner*—Terrence R. Till
(74) *Attorney, Agent, or Firm*—Duane, Morris & Heckscher LLP

(57) ABSTRACT

This invention relates to a device and system for cleaning the interior of conduits, gun barrels, or pipes, including drain pipes. The pipe cleaning device of the present invention is capable of (a) penetrating and removing restrictions that block flow, (b) scouring the interior wall of conduits or pipes to remove the buildup of undesirable solids that result in flow restriction, and (c) coating the wall of the pipe with a suitable substance. The present invention comprises a connecting member housed within a bendable or flexible conduit, a retraction handle attached to one end of the connecting member, and elastic or flexible strands attached to the opposite end of said connecting member. The strands are outwardly expandable in a radial dimension when said connecting member is retracted.

18 Claims, 3 Drawing Sheets

FLEXIBLE PIPE CLEANING DEVICE AND SYSTEM

BACKGROUND OF THE INVENTION

1. Field of the Invention

This invention relates to a device and system for cleaning the interior of conduits, pipes, or gun barrels including drain pipes. The pipe cleaning device of the present invention is capable of both (a) penetrating and removing restrictions that block flow, (b) scouring the interior wall of conduits or pipes to remove the buildup of undesirable solids that result in flow restriction, and (c) coating the wall of the pipe with a suitable substance. The present invention comprises a connecting member housed within a bendable or flexible conduit, a retraction handle attached to one end of the connecting member, and elastic or flexible strands attached to the opposite end of said connecting member. The strands are outwardly expandable in a radial dimension when said connecting member is retracted.

2. Description of the Prior Art

The presence of solids in pipes intended to permit fluid flow can lead to flow restriction or blockage that is undesirable. In drain pipes such blockage often results from solids or other particulate matter entering the pipes through a drain opening. Three methods employed by the prior art for cleaning clogged or blocked pipes involve the use of chemical cleaners intended to dissolve flow restrictions, pressurized fluids, and the use of mechanical cleaning devices, known as augers or plungers.

Chemical cleaners often use liquids that are strong acids or strong bases. Such liquids can cause corrosive damage to metallic pipes or result in severe injury if they come in contact with exposed portions of the human body, or if they are ingested. Such cleaners are particularly dangerous in households with young children. Pressurized fluid methods can also result in the splashing of liquids on the operator, thereby causing bodily harm to the operator.

Prior art augers comprise a bendable or flexible member coupled to a penetrating member that is attached to the distal end and rotatable handle attached to the proximal end. Prior art augers are designed to be inserted into a clogged pipe to the point that the penetrating member contacts the flow blockage. The handle is then rotated to cause the flexible member to rotate.

Such rotational motion facilitates the penetration or drilling of the flow blockage by the penetrating member.

Prior art augers function to remove blockages that substantially block the cross sectional flow area of a pipe or conduit. One of the many drawbacks of prior art augers is that they have little utility in reducing or cleaning the buildup of impurities on the inner walls of pipes or conduits. Such impurities serve as flow restrictors and may eventually result in total flow blockage if allowed to continue to propagate.

An advantage of the present invention is that the main shaft or flexible conduit can be firmly held in one hand by a user while the user's other hand rotates a retraction device which causes rotation of the flexible strands. This rotational functionality is provided by a rotatable coupling member. This is an improvement over prior art pipe cleaning devices wherein the flexible strands will rotate only if the main shaft or flexible conduit to which they are attached rotates.

The present invention overcomes the drawbacks and limitations of prior art augers by providing a device that can (a) remove flow blockages that block the cross sectional area of a flow path, (b) scour the inner wall of flow paths to remove the buildup of impurities, or other undesirable material, and (c) be rotated while the conduit is firmly gripped by a user in one hand. The present invention also provides for easy reciprocating operation that can be accomplished using minimal finger movement. The present invention overcomes the drawbacks of chemical cleaners by providing a pipe cleaning device that is not environmentally hazardous or poisonous.

The present invention offers several additional advantages over the prior art. It pulls plugs or flow restrictions apart, allowing breakup of the restrictions. It is capable of grabbing all or portions of a plug or restriction in order to remove it. The present invention further utilizes intermittent or constant expansion and contraction action of elastic strands to disrupt the integrity of a plug or a flow restriction. The present invention enables a coating material to be applied to the inner surface of a conduit, gun barrel, or pipe.

SUMMARY OF THE INVENTION

The present invention is directed toward a device and system for cleaning the interior of conduits, gun barrels, or pipes, including drain pipes. The device embodiment of the present invention comprises a flexible conduit having a proximal end and a distal end, a flexible connecting member slidably housed within the conduit, at least two elastic strands having proximal and distal ends, a rotatable coupling member mounted adjacent to the distal end of said conduit, and a retraction handle attached to the proximal end of the connecting member such that pushing and pulling the handle results in a reciprocating motion of the connecting member. The connecting member comprises a proximal connecting end region protruding beyond the proximal end of the conduit and a distal connecting end region protruding beyond the distal end of the conduit.

The proximal end of each elastic strand is attached to the coupling member. The distal end of the strands are attached to the distal end region of the connecting member such that when the connecting member is retracted, the strands are displaced outward and when the connecting member is not retracted, the strands are displaced in a substantially close configuration with respect to each other.

The system embodiment of the present invention may also comprise a pressure/suction source coupled to the proximal end of the conduit. The pressure/suction source is capable of either injecting pressurized fluid into the conduit or creating a pressure or suction in the conduit.

The present invention may be used to break up a flow restriction into smaller pieces. The injection of pressurized fluid can then be used to dissolve or blow the smaller pieces away. Alternatively, the suction source that can be used with the system embodiment of the present invention can be used to suck the smaller pieces out of the pipe or conduit.

The present invention further comprises a retraction device. The retraction device is connected to the proximal end of the flexible conduit and to the proximal end region of the connecting member such that axial displacement of the retraction device results in axial displacement of the connecting member. In one embodiment, rotation of the retraction device causes rotation of the connecting member, coupling member and flexible strands. The invention may further comprise a handle attached to the retraction device and to the tubular housing such that when the handle is rotated, the housing is rotated.

DETAILED DESCRIPTION OF THE PREFERRED EMBODIMENT

Figure 1A:
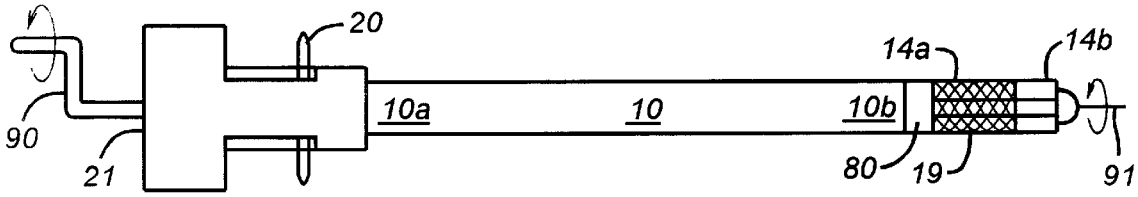
FIG. 1*a* is a side view of the device embodiment of the present invention comprising an expandable covering around the strands.
Figure 1B:
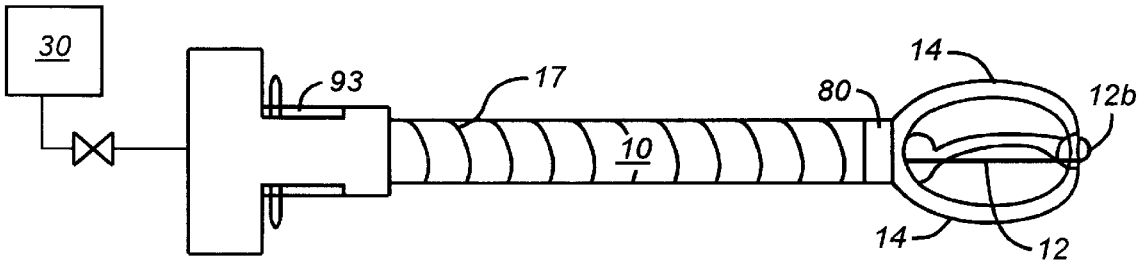
FIG. 1*b* is a side view of a system embodiment of the present invention with a conduit comprising reinforcing material.

As shown in FIGS. 1*a* and 1*b*, the present invention is directed toward a pipe cleaning device comprising a flexible conduit 10 having a proximal end 10*a* and a distal end 10*b*. In a preferred embodiment, the conduit 10 comprises reinforcing material 17 integrally housed within the conduit, as shown in FIG. 1*b*. The reinforcing member may be wire or string.

Figure 1C:
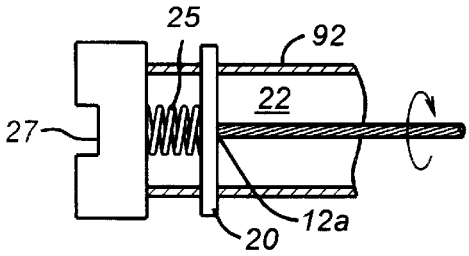
FIG. 1*c* is a side cutaway view of the retraction handle of the present invention.

The invention further comprises a flexible connecting member 12 slidably housed within the conduit. The connecting member comprises a proximal connecting end region 12*a* protruding beyond the proximal end of the conduit. It further comprises a distal connecting end region 12*b* protruding beyond the distal end of the conduit. In a preferred embodiment, the connecting member 12 is a cable, as shown in FIG. 1*c*. The connecting member may also be a wire, as shown in FIG. 1*b*. In preferred embodiments, the distal end of the connecting member is shaped in a J-hook or loop configuration to facilitate passage of the present invention in pipes having curves or bends.

Figure 4:
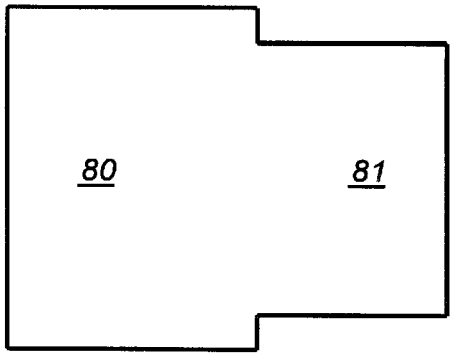
FIG. 4 is a side view of a first embodiment of the coupling member of the present invention.
Figure 5:
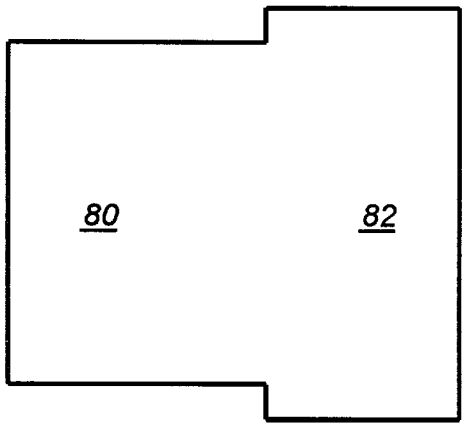
FIG. 5 is a side view of a second embodiment of the coupling member of the present invention.

The invention further comprises a rotatable coupling member 80 mounted adjacent to the distal end of the conduit. In a preferred embodiment, the rotatable coupling member comprises a male extension sleeve 81 which is insertable inside the distal end of the conduit, as shown in FIG. 4. In another preferred embodiment, the rotatable coupling member comprises a female extension sleeve 82 which fits over the distal end of said conduit and sized to allow rotation of said coupling member with respect to said conduit, as shown in FIG. 5.

The invention comprises at least two flexible or elastic strands 14 having proximal and distal ends. The proximal end of each strand 14*a* is attached to the coupling member. The distal ends of each stand 14*b* is fastened to the distal end region of the connecting member such that when the connecting member is retracted, strands are bowed or displaced outward, as shown in FIG. 1*b*. The strands are further connected to the distal end region of the connecting member such that when the connecting member is not retracted, the strands are displaced in a substantially closed or nonbowed configuration with respect to each other, as shown in FIG. 1*a*.

Figure 2A:
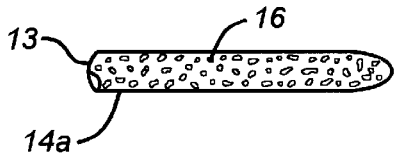
FIG. 2*a* is a top view of an outer surface of the strand comprising abrasive material.
Figure 2B:
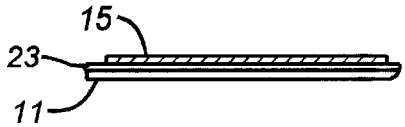
FIG. 2*b* is a side view of a strand comprising absorbent material.
Figure 6A:
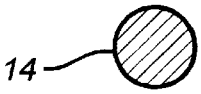
FIGS. 6*a*–6*c* are cross sectional views of various embodiments of the strands of the present invention.
Figure 6B:
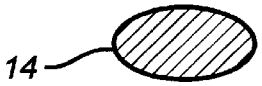
Figure 6C:
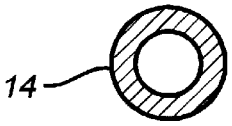
Figure 7:
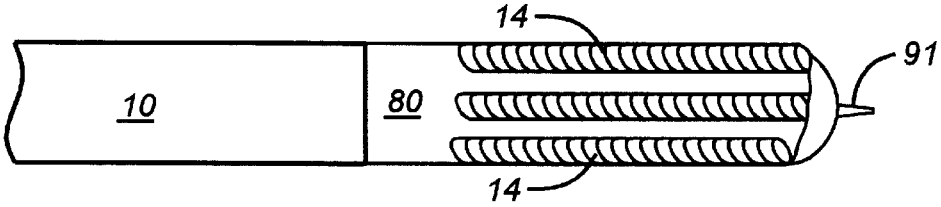
FIG. 7 is a side view of a coiled spring strand embodiment of the present invention.

In a preferred embodiment, the strands comprise a reinforcing material 23 integrally housed within said strands, as shown in FIG. 2*b*. The strands may have a variety of geometries and/or cross sectional areas. In one embodiment, the strands have a rectangular cross sectional area. In other embodiments, the cross sectional area of the strands are round or oval, as shown in FIGS. 6*a* and 6*b*, respectively. In another embodiment, the strands are tubular, as shown in FIG. 6*c*. In another embodiment, the strands may be coiled springs, as shown in FIG. 7.

As shown in FIGS. 2*a* and 2*b*, the strands comprise an outer radial surface 13 and an inner radial surface 11. In a preferred embodiment, the outer surface of the strands comprise a fluid absorbent member 15, as shown in FIG. 2*b*. In another preferred embodiment, the strands are ribbon shaped, as shown in FIG. 2*a*. In another preferred embodiment, the outer surface of the strands comprises an abrasive material 16. Such abrasive material enables the invention to grind away the buildup of impurities on the inner walls of conduits, gun barrels, or pipes within which the invention is used. This grinding action can be accomplished by either reciprocating the handle of the invention or by rotating the invention within the conduit when the handle is retracted.

In another preferred embodiment, the strands are surrounded by an expandable covering 19 that may be absorbent or abrasive, as shown in FIG. 1*a*. Where the expandable covering is made from absorbent material, such absorbent material enables the invention to apply suitable material to dissolve or otherwise remove impurities which are built up on the inner walls of conduits, gun barrels, or pipes. Such absorbent material also enables the invention to apply suitable coating material such as lubricants or protective agents on the inner walls of conduits, gun barrels or pipes. In a preferred embodiment, the expandable covering may be a sock secured to said strands by Velcro® or a purse string.

In another preferred embodiment, the strands are made from a material that is detectable by x-rays or by ultrasound energy. Such material construction allows for a determination of the exact position of the strands within a pipe or conduit, using either an external source of x-rays or ultrasound energy.

The invention further comprises a retraction device 20 attached to the proximal end of the connecting member such that pushing and pulling the retraction device results in a reciprocating motion of the connecting member, as shown in FIGS. 1*a* and 1*b*. In a preferred embodiment, the retraction device is attached to the proximal end of the connecting member such that rotation of the retraction device causes rotation of the connecting member, coupling member, and flexible stands. This rotational functionality is denoted by the curved arrows in FIGS. 1*a* and 1*c*.

In one preferred embodiment, the retraction device is a handle comprising an outer housing 21 sized to fit within the palm of an adult human hand. The retraction handle further comprises an inner cavity 22 within the outer housing. The inner cavity is sized to permit reciprocating movement of the handle 21 and connecting member 12 within the cavity, as shown in FIG. 1*c*. In a preferred embodiment, the retraction handle is attached to the connecting member located within the inner cavity. The retraction handle or device protrudes beyond the outer housing such that its protruding portion may be pushed or pulled by one or more fingers of an adult human hand, as shown in FIGS. 1*a*–1*c*.

In another preferred embodiment, the retraction device comprises a tubular housing 92 having a first end attached to the proximal end of the conduit and a second end extending outside the conduit. The tubular housing further has a slot 93 extending through a wall in the housing. In this embodiment, the retraction device further comprises a retraction member 20 connected to the proximal end of the connecting member 12*a,* as shown in FIG. 1*c*.

In a preferred embodiment, an elastic compression resistance member 25 is installed in the inner cavity of the retraction handle and mechanically coupled to the retraction handle to provide a restoring force capable of restoring the retraction handle to a position where the connecting member is not retracted when the retraction handle is not subject to external force, as shown in FIG. 1*c*. In a preferred embodiment, the compression resistance member is a spring 25, as shown in FIG. 1*c*. In another preferred embodiment, the retraction handle encompasses a pistol grip like action.

In a preferred embodiment, the retraction handle comprises a coupling receptacle 27 mounted in the top of the outer housing 21 such that the retraction device can be coupled to a rotational motion device, such as a drill.

In another preferred embodiment, the retraction handle is an elastic ribbon-like member formed in the shape of an ellipse and joined at each end to the conduit. The proximal end of the connection member is affixed to this retraction handle at a point furthest from the proximal end of the conduit, such that when the ribbon-like retraction handle is squeezed, the point where the connecting member is attached is moved further away from the proximal end of the conduit, thereby retracting the connecting member. When the squeezing of the ribbon-like retraction handle is stopped, the connecting member is returned to its unretracted position.

The device embodiment of the present invention may also be coupled with a pressure/suction source to produce a system embodiment of the present invention. In its system embodiment, the present invention comprises the elements described above. Additionally, the present invention comprises a pressure/suction source 30, coupled to the proximal end of the conduit, as shown in FIG. 1*b*. The pressure/suction source is capable of either injecting pressurized fluid into the conduit or creating a pressure or suction in the conduit. Such pressure or suction is transmitted to the pipe, gun barrel, or drain pipe.

Figure 3A:
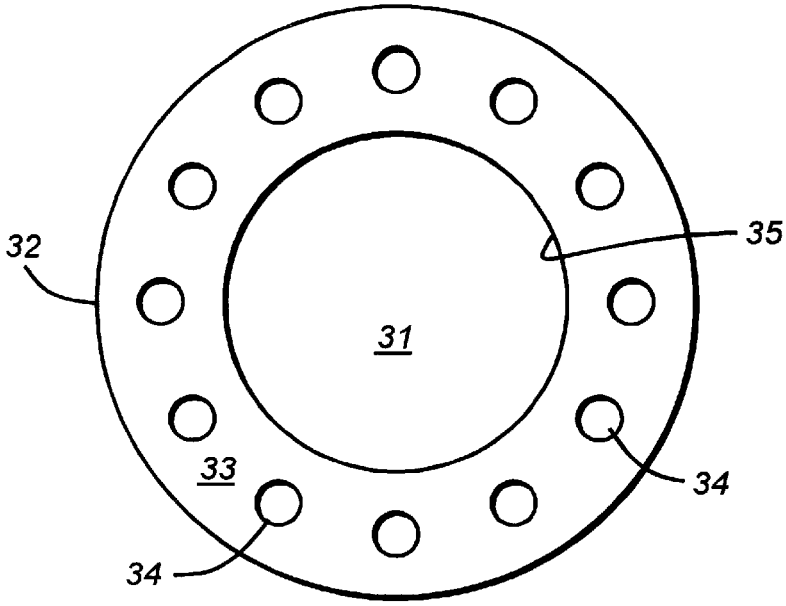
FIG. 3*a* is a top view of the strainer cap of the present invention.
Figure 3B:
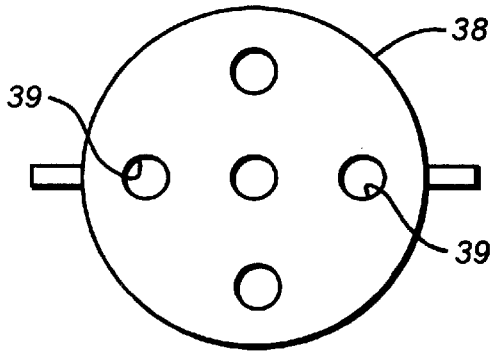
FIG. 3*b* is a top view of the central insert for the strainer cap of the present invention.
Figure 3C:
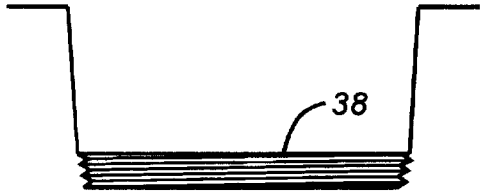
FIG. 3*c* is a side view of the central insert for the strainer cap of the present invention.

The present invention, in either its device or system embodiment, may be used in conjunction with a customized drain cap, of the type shown in FIGS. 3*a*–3*c*. Such a cap permits the present invention to be easily inserted into a pipe or conduit to be cleaned, such as the drain pipe of a sink.

The circular drain strainer cap 32 of the present invention is shown in FIG. 3*a*. This strainer cap comprises an outer radial region 33 and an inner radial region 31. The outer radial region comprises one or more drain holes 34. The inner radial region comprises a central opening 35, sized to permit insertion and passage of the strands and conduit of the present invention.

When the circular drain strainer cap is not being used in conjunction with the pipe cleaning device of the present invention, its inner radial region can be used for normal draining and straining purposes by using the central insert 38 of the present invention, shown in FIG. 3*b*. This central insert comprises one or more drain holes 39. This insert is sized to fit within the central opening of the circular drain strainer cap when the conduit is not inserted in the central opening. As shown in FIG. 3*c,* the central insert 38 is threaded or snapped in so that it may be screwed or snapped into or out of the central opening of the circular drain strainer cap.

This embodiment further comprises a leading member 91 having a proximal region attached to the distal connecting end and to the distal ends of the strands, such that when the connecting member is retracted, the leading member is also retracted, resulting in the outward radial displacement of the strands, and when the connecting member is not retracted, the strands are displaced in a substantially closed configuration with respect to each other, as shown in FIG. 1*a*. Additionally, the leading member is attached to the strands such the leading member rotates when the strands rotate, as depicted by the curved arrow near leading member 91 in FIG. 1*a*. In a preferred embodiment, the connecting member and the leading member are integrally formed.

In another preferred embodiment, the invention further comprises a rotation handle 90 attached to the retraction member or device. The rotation handle extends beyond the housing, as shown in FIG. 1*a*. When the rotation handle is rotated, the retraction device, connecting member and strands rotate, as shown by the curved arrows in FIG. 1*a*.

The foregoing disclosure and description of the invention are illustrative and explanatory thereof, and various changes in the size, shape and materials, as well as in the details of the illustrated construction, may be made without departing from the spirit of the invention.

What is claimed is:

1. A pipe cleaning device comprising:

a. a flexible conduit having a proximal end and a distal end;

b. a flexible connecting member slidably housed within said conduit, said connecting member comprising a proximal connecting end region protruding beyond the proximal end of said conduit and a distal connecting end region;

c. a rotatable coupling member mounted adjacent to the distal end of said conduit;

d. at least two flexible strands having distal ends attached to the distal end region of said connecting member and having proximal ends attached to said coupling member; and e. a retraction device attached to the proximal end region of said connecting member such that axial displacement of said retraction device results in axial displacement of said connecting member and such that rotation of said retraction device causes rotation of said connecting member, coupling member and flexible strands.

2. The device of claim 1, further comprising a leading member having a proximal region attached to said distal connecting end and to the distal ends of said strands, such that when said connecting member is retracted, said leading member is also retracted, resulting in the outward radial displacement of said strands and when said connecting member is not retracted, said strands are displaced in a substantially closed configuration with respect to each other.

3. The device of claim 2, wherein said connecting member and said leading member are integrally formed.

4. The device of claim 1, wherein said retraction device comprises:

a. a tubular housing having a first end rotatably attached to the proximal end of said conduit, a second end extending outside said conduit, and a slot extending through a wall of said housing;

b. a retraction member connected to the proximal end of said connecting member.

5. The device of claim 4, further comprising a rotation handle attached to said retraction member, said rotation handle extending beyond said housing.

6. The device of claim 1, wherein said strands are ribbon shaped.

7. The device of claim 1, wherein said coupling member comprises a male extension sleeve extending inside the distal end of said conduit.

8. The device of claim 1, wherein said coupling member comprises a female extension sleeve extending over the distal end of said conduit and sized to allow rotation of said coupling member with respect to said conduit.

9. A pipe cleaning system comprising:

a. a flexible conduit having a proximal end and a distal end;

b. a flexible connecting member slidably housed within said conduit, said connecting member comprising a proximal connecting end region protruding beyond the proximal end of said conduit and a distal connecting end region;

c. a rotatable coupling member mounted adjacent to the distal end of said conduit;

d. at least two flexible strands having distal ends attached to the distal end region of said connecting member and having proximal ends attached to said coupling member;

e. a retraction device attached to the proximal end region of said connecting member such that axial displacement of said retraction device results in axial displacement of said connecting member and such that rotation of said retraction device causes rotation of said connecting member, coupling member and flexible strands; and f. a rotation handle attached to said retraction device such that rotation of said handle causes rotation of said retraction device.

10. The device of claim 9, further comprising a leading member having a proximal region attached to said distal connecting end and to the distal ends of said strands, such that when said connecting member is retracted, said leading member is also retracted, resulting in the outward radial displacement of said strands and when said connecting member is not retracted, said strands are displaced in a substantially closed configuration with respect to each other.

11. The device of claim 9, wherein said coupling member comprises a male extension sleeve extending inside the distal end of said conduit.

12. The device of claim 9, wherein said coupling member comprises a female extension sleeve extending over the distal end of said conduit and sized to allow rotation of said coupling member with respect to said conduit.

13. The device of claim 9, wherein said strands are ribbon shaped.

14. The device of claim 9, wherein the outer surface of the strands comprise an abrasive material.

15. The device of claim 9, further comprising a rotation handle attached to said retraction device, such that rotation of the rotation handle causes rotation of the retraction device, connecting member and strands.

16. The device of claim 9, wherein the cross sectional area of said strands is round or oval.

17. The device of claim 9, wherein said strands are tubular.

18. The device of claim 9, wherein said strands are coiled springs.

* * * * *